US009384930B2

(12) United States Patent
Lu

(10) Patent No.: US 9,384,930 B2
(45) Date of Patent: Jul. 5, 2016

(54) FUSE APPLIANCE

(75) Inventor: Kejun Lu, Shanghai (CN)

(73) Assignee: NOARK ELECTRONICS (SHANGHAI) CO. LTD. (CN)

( * ) Notice: Subject to any disclaimer, the term of this patent is extended or adjusted under 35 U.S.C. 154(b) by 236 days.

(21) Appl. No.: 14/004,099

(22) PCT Filed: Jan. 12, 2012

(86) PCT No.: PCT/CN2012/070274
§ 371 (c)(1),
(2), (4) Date: Sep. 9, 2013

(87) PCT Pub. No.: WO2012/122862
PCT Pub. Date: Sep. 20, 2012

(65) Prior Publication Data

US 2014/0009255 A1 Jan. 9, 2014

(30) Foreign Application Priority Data

Mar. 11, 2011 (CN) ..... 2011 1 0059586

(51) Int. Cl.
*H01H 85/60* (2006.01)
*H01H 85/54* (2006.01)
(Continued)

(52) U.S. Cl.
CPC ..... *H01H 85/60* (2013.01); *H01H 85/545* (2013.01); *H01H 85/547* (2013.01); *H01H 9/102* (2013.01); *H01H 9/104* (2013.01); *H01H 31/122* (2013.01); *H01H 85/54* (2013.01)

(58) Field of Classification Search
CPC ..... H01H 85/485; H01H 85/52; H01H 85/54; H01H 85/542; H01H 85/545; H01H 85/547; H01H 85/56; H01H 85/58; H01H 85/60; H01H 9/102; H01H 9/104; H01H 31/122
USPC ..... 337/171–173, 180, 181, 196, 208
See application file for complete search history.

(56) References Cited

U.S. PATENT DOCUMENTS 3,406,365 A * 10/1968 Lameyre ..... H01H 21/165 337/10
4,268,106 A * 5/1981 Moerre ..... H01H 85/545 337/194

(Continued)

FOREIGN PATENT DOCUMENTS

CN 2076706 5/1991
CN 2491963 5/2002

(Continued)

OTHER PUBLICATIONS

Machine translation of JP 2007258143 A, Ayabe.*

(Continued)

*Primary Examiner* — Anatoly Vortman
*Assistant Examiner* — Jacob Crum
(74) *Attorney, Agent, or Firm* — Ostrolenk Faber LLP

(57) ABSTRACT

A fuse appliance has a fuse carrier for receiving a fuse and a base. The fuse carrier is in a cavity of the base and is manually operable to remove or insert the fuse. Fixed contacts are provided on the base which engage with moving contacts provided on the carrier. Wiring terminals are electrically connected to the fixed contacts. A rotational-linear pulling operation mechanism has a semicircular rotary shaft structure that has two semicircular convex shafts and first and second circular straight grooves fitted to each other so that the fuse carrier performs rotational and linear movements relative to the base and an interchange between rotational and linear movements at a transition position when the carrier is pulled out of or pushed into the appliance.

11 Claims, 5 Drawing Sheets

(51) Int. Cl.
*H01H 31/12* (2006.01)
*H01H 9/10* (2006.01)

(56) References Cited

U.S. PATENT DOCUMENTS

| | | | | |
|---|---|---|---|---|
| 5,532,668 | A * | 7/1996 | Fennell | 337/168 |
| 8,310,333 | B2 * | 11/2012 | Ventura et al. | 337/211 |
| 2003/0201866 | A1 * | 10/2003 | Sudan et al. | 337/188 |
| 2004/0100387 | A1 * | 5/2004 | Torrez et al. | 340/638 |
| 2005/0098419 | A1 * | 5/2005 | Matsui et al. | 200/311 |
| 2005/0285710 | A1 * | 12/2005 | Buettner | 337/231 |
| 2009/0243786 | A1 * | 10/2009 | Buettner | 337/203 |
| 2010/0124850 | A1 * | 5/2010 | Hong et al. | 439/620.26 |
| 2010/0233893 | A1 | 9/2010 | Buettner | |

FOREIGN PATENT DOCUMENTS

| | | | |
|---|---|---|---|
| CN | 1357154 | | 7/2002 |
| CN | 101026057 | A | 8/2007 |
| CN | 101226833 | | 7/2008 |
| CN | 201207362 | | 3/2009 |
| CN | 102122594 | | 7/2011 |
| EP | 0 068 956 | A1 | 1/1983 |
| JP | 2007258143 | A * | 10/2007 |

OTHER PUBLICATIONS

International Search Report dated Apr. 19, 2012 issued in corresponding International patent application No. PCT/CN2012/070274.

* cited by examiner

FUSE APPLIANCE

CROSS REFERENCE TO RELATED APPLICATIONS

The present application is a 35 U.S.C. §371 National Phase conversion of PCT/CN2012/070274, filed Jan. 12, 2011, which claims benefit of Chinese Application No. 2011 10059586.5, filed Mar. 11, 2011, the disclosure of which is incorporated herein by reference. The PCT International Application was published in the Chinese language.

TECHNICAL FIELD

The present invention relates to a fuse appliance, in particular to a detachable low-voltage fuse appliance with an opening type structure.

BACKGROUND

The fuse is a kind of electrical appliance for security protection, it can be used for isolated protection between power source and loads, is also widely used as a protector for power grid or electrical equipment, namely, fuse appliance is capable of automatically switching circuits off in case of short-circuit or overload in power grid or line of electrical equipment, in order to avoid damage to electrical appliances and equipment and prevent the spread of the accident. The basic structure of a fuse appliance consists mainly of three parts, including a fuse, a fuse carrier and a fuse appliance base. The fuse plays such a role that it will get overheated and melts when excessive current is caused by circuits overload or short-circuit failure, thereby putting electrical equipment under protection. The fuse carrier and the fuse appliance base are used for support, insulation and protection and are made of insulating materials. A cavity for receiving the fuse is arranged on the fuse carrier, moving contacts of the fuse appliance are arranged on the two sides of the cavity, the fuse carrier is generally manufactured to be manually operable, so as to remove or insert the fuse when the fuse is replaced by an operator. Fixed contacts that can come into contact with the moving contacts arranged on the fuse carrier and wiring terminals are arranged on the fuse appliance base, and the fuse appliance base is used not only for mounting and fixing the fuse, but also for realizing an electrical connection between the fuse and the circuit. During the use of the fuse appliance, fuse replacement is often needed, namely removing the old or blown fuse and inserting a new fuse, and this operation is a charged operation, therefore, convenience and easiness are required in the fuse replacement operation, furthermore, operator's safety must be guaranteed.

Fuse appliances in the prior art can be classified in two types based upon their fuse replacement ways, i.e. straight pull type and rotational type. The straight pull type fuse appliance is characterized in that, when the fuse is replaced or mounted, the fuse carrier for carrying the fuse in the fuse appliance base is directly pulled out of the base to isolate the fuse from the contacts, such a structure has the advantage of large isolation distance between the fuse and the contacts to further result in good safety, however, the operation is laborious and inconvenient. The rotational type fuse appliance is characterized in that, when the fuse is replaced or mounted, the fuse carrier is rotated about a fixed fulcrum of the base by a particular angle in order to isolate the fuse from the contacts, such a structure has the advantage of labor-saving operation, but there is a small isolation distance between the fuse and the contacts, which means poor safety. However, in order to solve the aforementioned shortcomings in the prior art, innovation needs to be put on an operation mechanism of the fuse carrier in relation to the fuse appliance base, and with this novel operation mechanism, such use requirements as small operation force, convenient fuse replacement and good operation safety can be met, in addition, optimization on the structure and functionalities of the fuse appliance can also be implemented.

SUMMARY OF THE INVENTION

The objectives of the present invention is to overcome the shortcomings in the prior art and provide a fuse appliance. The fuse appliance employs a set of operation mechanism that are skillfully designed, is capable of not only integrating two movement types, i.e. straight pulling type and rotational type, according to the requirements, but also facilitating an interchange between these two movement types, i.e. straight pulling type and rotational type, has the advantages of labor-saving operation, good safety, convenient fuse replacement and high rapidness, and further has the functions of anti-excessive-rotation, anti-turn back-rotation, anti-pull-off and display.

To achieve the aforementioned objectives, adopted in the present invention is the following technical scheme.

A fuse appliance comprises a fuse 8, a fuse carrier 2 and a fuse appliance base both made of insulating material, the fuse carrier 2 is provided with a cavity for receiving the fuse 8, moving contacts of the fuse appliance are arranged on the two sides of the cavity, the fuse carrier 2 is arranged, in a manually operable way, in a hollow cavity of the fuse appliance base that is formed by buckling and assembling a shell bottom 1 and a shell cover 3, so as to remove or insert the fuse 8 when the fuse 8 is replaced by an operator, and arranged on the two sides of the fuse appliance base are fixed contacts 6, 9 which come into contact with moving contacts arranged on the fuse carrier 2, and wiring terminals 4, 5 for electrically connecting the two contacts 6 and 9 of the fuse appliance with a main circuit respectively. The fuse appliance further comprises a rotational-linear pulling type operation mechanism formed by a semicircular rotary shaft structure 100, the semicircular rotary shaft structure 100 comprises two semicircular convex shafts 21 and first and second circular straight grooves 11 and 31, and the two semicircular convex shafts 21 are in mounting fit with the first circular straight groove 11 and the second circular straight groove 31 respectively, so that the fuse carrier 2 performs rotational movement or linear movement below in relation to the fuse appliance base, during the closing operation stage of the fuse appliance, the fuse carrier 2 can perform rotational movement in relation to the fuse appliance base only and cannot perform linear movement; during the opening operation stage of the fuse appliance, the fuse carrier 2 can accomplish an interchange between these two movement forms, i.e. rotational movement and linear movement, in relation to the fuse appliance base at a transition position where the fuse carrier is pulled out of or pushed into the fuse appliance; and during the pull-out or push-in operation stage of the fuse appliance, the fuse carrier 2 can perform linear movement only in relation to the fuse appliance base.

The present invention further provides another fuse appliance, comprising a fuse 8, a fuse carrier 2 made of insulating material and a fuse appliance base made of insulating material, the fuse carrier 2 is arranged in a cavity for receiving the fuse 8, moving contacts of the fuse appliance are arranged on the two sides of the cavity, the fuse carrier 2 is arranged, in a manually operable way, in a hollow cavity of the fuse appliance base that is formed by buckling and assembling a shell bottom 1 and a shell cover 3, so as to remove or insert the fuse 8 when the fuse 8 is replaced by an operator, and arranged on the two sides of the fuse appliance base are fixed contacts 6 and 9 which come into contact with moving contacts arranged on the fuse carrier 2, and wiring terminals 4, 5 for electrically connecting the two contacts 6, 9 of the fuse appliance with a main circuit respectively. The fuse appliance further comprises a rotational-linear pulling type operation mechanism; the rotational-linear pulling type operation mechanism comprises a semicircular rotary shaft structure 100 and a linear movement type guide rail structure 200. The semicircular rotary shaft structure 100 comprises two semicircular convex shafts 21 as well as a first circular straight groove 11 and a second circular straight groove 31, the linear movement type guide rail structure 200 comprises two slider protrusions 24 as well as a first guide rail groove 113 and a second guide rail groove 313, the first guide rail groove 113 and the second guide rail groove 313 are arranged in parallel; and the two slider protrusions 24 are in slide fit with the first guide rail groove 113 and the second guide rail groove 313 respectively. The two semicircular convex shafts 21 of the semicircular rotary shaft structure 100 are in mounting fit with the first circular straight groove 11 and the second circular straight groove 31 respectively, and the two slider protrusions 24 of the linear movement type guide rail structure 200 are in mounting fit with the first guide rail groove 113 and the second guide rail groove 313 respectively, so that the fuse carrier 2 performs rotational movement or linear movement below in relation to the fuse appliance base, during the closing operation stage of the fuse appliance, the two slider protrusions 24 are separated from the first guide rail groove 113 and the second guide rail groove 313 respectively, thus the fuse carrier 2 can perform rotational movement only in relation to the fuse appliance base and cannot perform linear movement; during the opening operation stage of the fuse appliance, the two slider protrusions 24 enter the inlets of the first guide rail groove 113 and the second guide rail groove 313 respectively, thus the fuse carrier 2 can accomplish an interchange between these two movement forms, i.e. rotational movement and linear movement, in relation to the fuse appliance base at a transition position where the fuse carrier is pulled out of or pushed into the fuse appliance; during the pull-out or push-in operation stage of the fuse appliance, the fuse carrier 2 is constrained to perform linear movement only in relation to the fuse appliance base; and the linear movement of the fuse carrier 2 constrained by the semicircular rotary shaft structure 100 and the linear movement of the fuse carrier 2 constrained by the linear movement type guide rail structure 200 are consistent in movement direction.

The two semicircular convex shafts 21 are formed on the fuse carrier 2, the first circular straight groove 11 and the second circular straight groove 31 are formed on the fuse appliance base; or one of the two semicircular convex shafts 21 is formed on the shell bottom 1 of the fuse appliance base while the other is formed on the shell bottom 3 of the fuse appliance base, and the first circular straight groove 11 and the second circular straight groove 31 are formed on the fuse carrier 2 respectively; the first circular straight groove 11 comprises a first circular groove 111 and a first straight groove 112, the radius R1 of the first circular groove 111 is equal to the width H1 of the first straight groove 112, one inner side face of the first straight groove 112 is tangent to the inner circular face of the first circular groove 111, and the first straight groove 112 is communicated with the first circular groove 111; the second circular straight groove 31 comprises a second circular groove 311 and a second straight groove 312, the radius R2 of the second circular groove 311 is equal to the width H2 of the second straight groove 312, one inner side face of the second straight groove 312 is tangent to the inner circular face of the second circular groove 311, and the second straight groove 312 is communicated with the second circular groove 311; in the two semicircular convex shafts 21, the radius RA of the semicircular convex shaft 21 in mounting fit with the first circular straight groove 11 is equal to the radius R1 of the first circular groove 111, the radius RB of the semicircular convex shaft 21 in mounting fit with the second circular straight groove 31 is equal to the radius R2 of the second circular groove 311, the axes of the two semicircular convex shafts 21 are concentric, and the centers of the first circular groove 111 and the second circular groove 311 are concentric; the first circular straight groove 11 and the second circular straight groove 31 are arranged symmetrically, the two semicircular convex shafts 21 are in clearance fit with the first circular groove 111 and the second circular groove 311 respectively, and the two semicircular convex shafts 21 are in slide fit with the first straight groove 112 and the second straight groove 312 respectively.

The two semicircular convex shafts 21 are identical semi-cylinders both having a semicircular cross section. Each semicircular convex shaft 21 comprises a plane 212 and a circular arc face 213 both parallel with the axis of the semicircular convex shaft 21, and the circular arc face 213 is a semi-cylindrical face of the semi-cylinder of the semicircular convex shaft 21.

The two slider protrusions 24 of the linear movement type guide rail structure 200 are formed on the fuse carrier 2, the first guide rail groove 113 is formed on the shell bottom 1 of the fuse appliance base, the second guide rail groove 313 is formed on the shell cover 3 of the fuse appliance base; or one of the two slider protrusions 24 of the linear movement type guide rail structure 200 is formed on the shell bottom 1 of the fuse appliance base while the other is formed on the shell bottom 3 of the fuse appliance base, and the first guide rail groove 113 and the second guide rail groove 313 are formed on the fuse carrier 2 respectively; inlets at the lower ends of the first guide rail groove 113 and the second guide rail groove 313 are horn-shaped, so as to guide the two slider protrusions 24 to enter the first guide rail groove 113 and the second guide rail groove 313 respectively. The upper ends of the first guide rail groove 113 and the second guide rail groove 313 are both blocked off by the shell bottom 1 of the fuse appliance base, so as to prevent the two slider protrusions 24 from being pulled out of the first guide rail groove 113 and the second guide rail groove 313 respectively.

The fuse appliance further comprises an anti-over-rotation positioning structure for the fuse carrier 2, the anti-over-rotation positioning structure comprises protrusions 118 formed on the shell bottom 1 and/or shell cover 3 and a convex shoulder 211 formed on the fuse carrier 2, and when the fuse carrier 2 is rotated to a closing position, the protrusions 118 come into contact with the convex shoulder 211 to limit forward over-rotation of the fuse carrier 2 under a closing state.

The fuse appliance further comprises an anti-turn back rotation positioning structure for the fuse carrier 2, the anti-turn back rotation positioning structure comprises a flange 115 formed on the shell bottom 1 and/or shell cover 3 and lug bosses 27 formed on the fuse carrier 2, and when the fuse carrier 2 is rotated to a closing position, the lug bosses 27 are clamped by the flange 115 to limit free turn back rotation of the fuse carrier 2 under a closing state.

The fuse appliance further comprises a guide plane 116 formed on the shell bottom 1 and/or shell cover 3 and a guide plane 28 formed on the fuse carrier 2; the guide plane 116 is parallel with the first circular straight groove 11 and the second circular straight groove 31; when the fuse carrier 2 is rotated to an opening position, the guide plane 116 is parallel with and comes into contact with the guide plane 28; and in the pull-out or push-in process of the fuse carrier 2, contact and relative sliding are generated between the guide plane 116 and the guide plane 28.

The fuse appliance further comprises an anti-pull-off stop block 114 formed on the shell bottom 1 and/or shell cover 3 and an anti-pull-off lug boss 26 formed on the fuse carrier 2; when the fuse carrier 2 is pulled out to reach the maximal pull-out position, the anti-pull-off lug boss 26 is stopped by the anti-pull-off stop block 114 in order to prevent the fuse carrier 2 from being pulled out.

The cavity of the fuse carrier 2 is in a shape of conical platform with an expanded opening, so that the fuse 8 can be inserted into or removed out of the cavity conveniently. A fuse stop block 22 is arranged at the opening of the cavity of the fuse carrier 2 so as to avoid free falling of the fuse 8 inside the cavity.

The fuse appliance further comprises a blown fuse indicator 7 arranged on the fuse carrier 2, the blown fuse indicator 7 comprises a resistor 72 mounted on the fuse carrier 2, an LED lamp 71, a contact piece and a display window 73, the contact piece is connected with the resistor 72 and the LED lamp 71 in series and is connected with the fuse 8 in parallel, and when the fuse appliance is under a closing state, but no fuse 8 is mounted or the fuse 8 is blown, the LED lamp 71 is on.

DETAILED DESCRIPTION OF THE EMBODIMENTS

Further detailed description is made below to the specific implementation of the present invention with reference to the embodiments shown in the accompanying drawings. The implementation of the present invention is not limited to the embodiments below.

Figure 1:
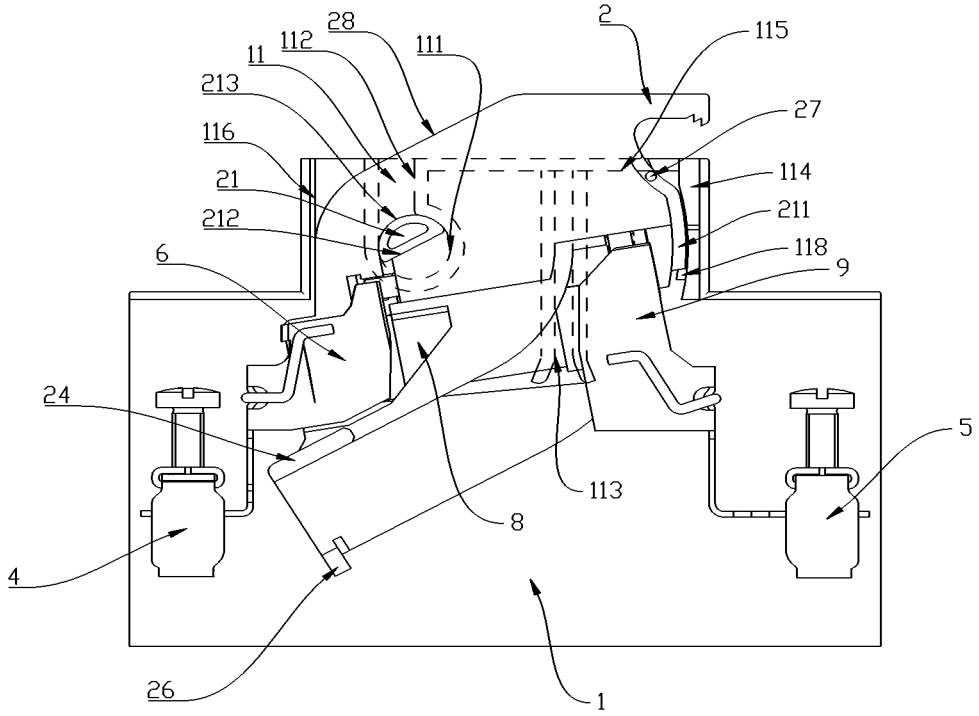
FIG. 1 is a structural plan view of the fuse appliance in accordance with the present invention, and illustrates an assembly relationship between the shell bottom of the fuse appliance base and the fuse carrier of the fuse appliance under a closing state.
Figure 2:
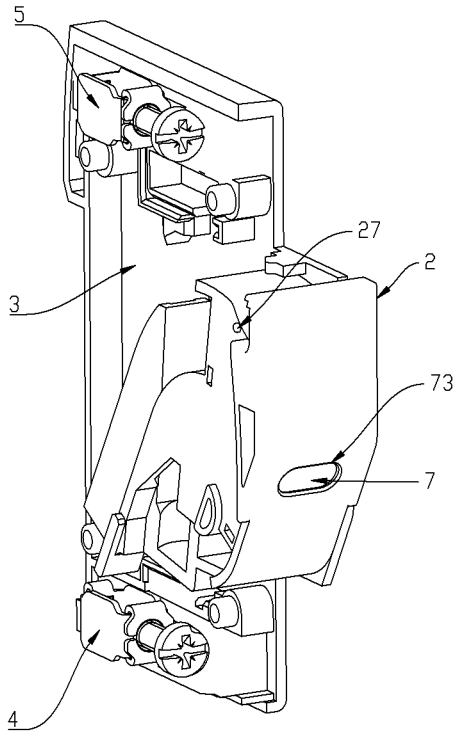
FIG. 2 is a perspective view of the fuse appliance as shown in FIG. 1, and illustrates an assembly relationship between the shell cover of the fuse appliance base and the fuse carrier of the fuse appliance under a closing state.
Figure 3:
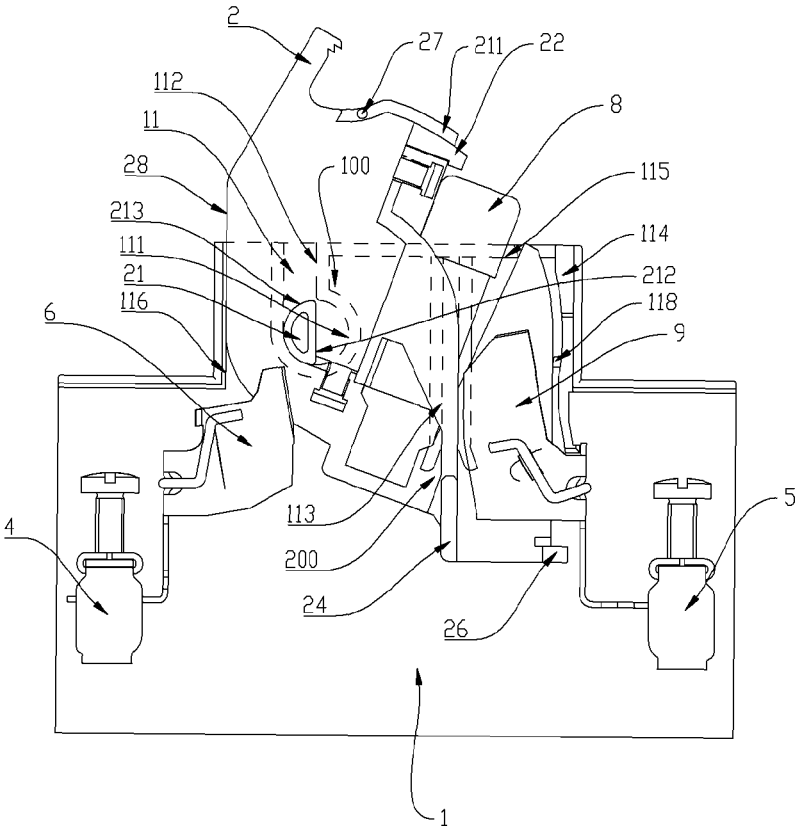
FIG. 3 is a structural plan view of the fuse appliance in accordance with the present invention, and illustrates an assembly relationship between the shell bottom of the fuse appliance base and the fuse carrier of the fuse appliance under an opening and pull-out preparation state.
Figure 4:
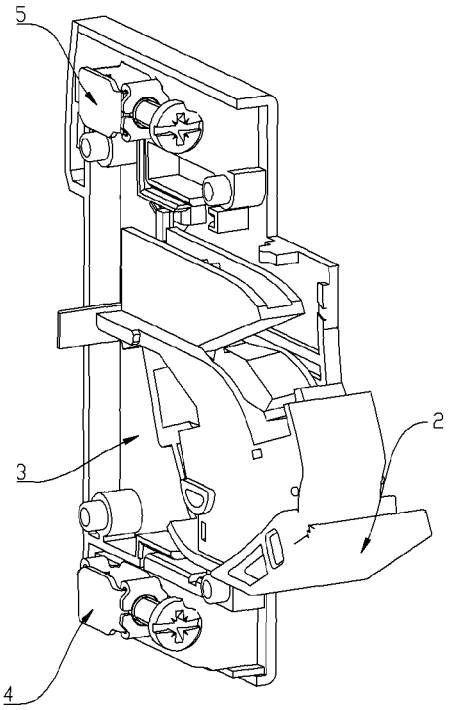
FIG. 4 is a perspective view of the fuse appliance as shown in FIG. 3, and illustrates an assembly relationship between the shell cover of the fuse appliance base and the fuse carrier of the fuse appliance under an opening state.
Figure 5:
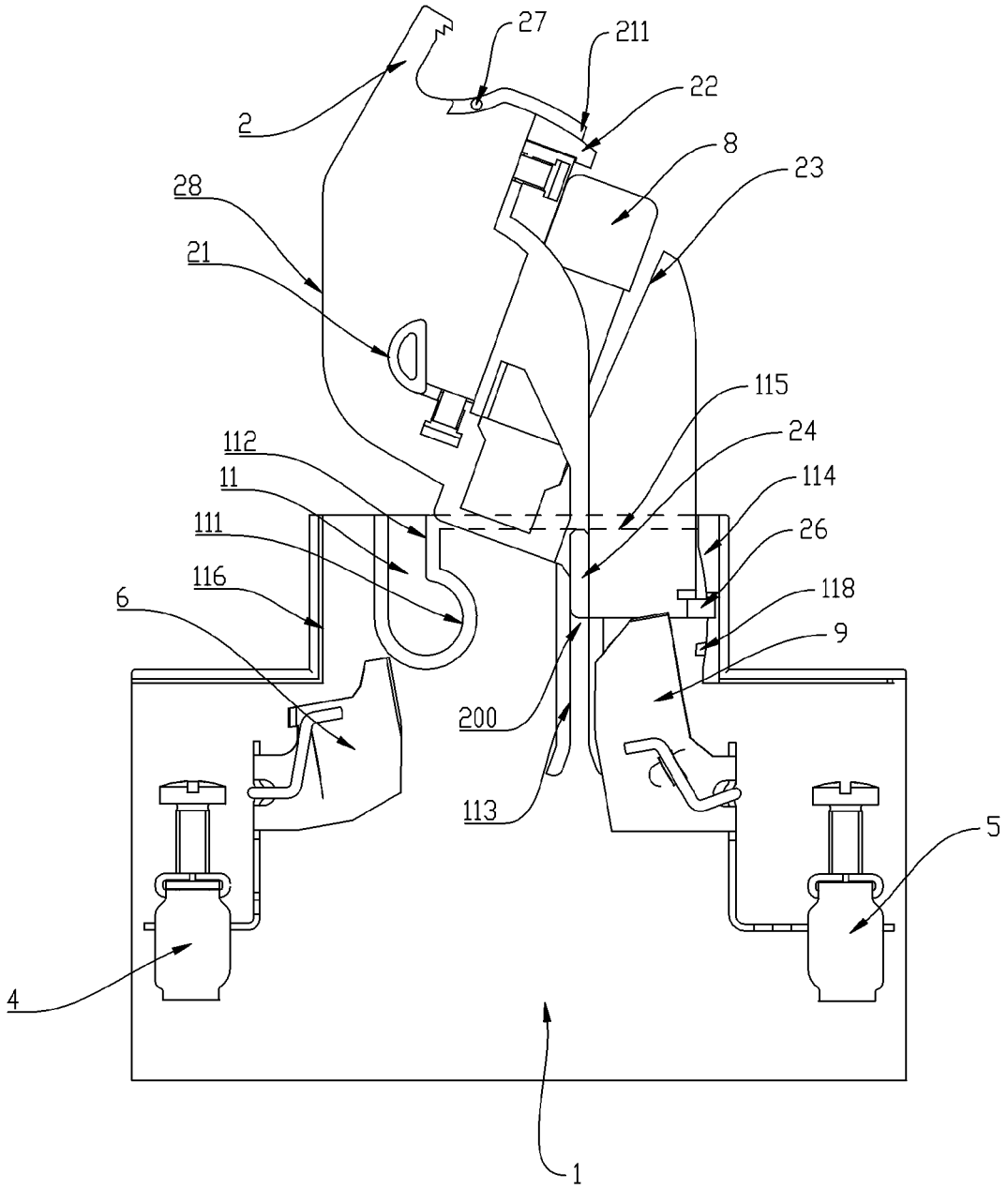
FIG. 5 is a structural plan view of the fuse appliance in accordance with the present invention, and illustrates an assembly relationship between the shell bottom of the fuse appliance base and the fuse carrier of the fuse appliance under a pull-out state.

Referring to the structural plan views and the perspective views of the closing, opening and pull-out states as shown in FIG. 1 to FIG. 6, the fuse appliance in accordance with the present invention comprises a fuse 8, a fuse carrier 2 made of insulating material and a insulating fuse appliance base. The fuse carrier 2 is provided with a cavity for receiving the fuse 8, moving contacts of the fuse appliance are arranged on the two sides of the cavity, and the cavity is in a shape of conical platform with an expanded opening, so that the fuse 8 can be inserted into or removed out of the cavity conveniently. A fuse stop block 22 is arranged at the opening of the cavity so as to avoid free falling of the fuse 8 inside the cavity. The fuse carrier 2 is arranged, in a manually operable way, on the fuse appliance base, so as to remove or insert the fuse 8 when the fuse 8 is replaced by an operator. The fuse appliance base is formed by buckling and assembling a shell bottom 1 and a shell cover 3, and the fuse carrier is carried in a hollow cavity formed by the buckling the shell bottom 1 and the shell cover 3. Arranged on the two sides of the fuse appliance base are fixed contacts 6, 9 and wiring terminals 4, 5, fixed contacts 6, 9 come into contact with the moving contacts arranged on the fuse carrier 2, wiring terminals 4, 5 connect with the wires of a main circuit, in the embodiments as shown in FIG. 1, FIG. 3 and FIG. 5, one of the two wiring terminals is mounted on the shell bottom 1 of the fuse appliance base while the other is mounted on the shell cover 3, the two wiring terminals 4, 5 are electrically connected with the two contacts 6, 9 respectively, and specifically, the wiring terminal 4 is electrically connected with the contact 6 while the wiring terminal 5 is electrically connected with the contact 9. Apparently, these two wiring terminals 4, 5 may also be both mounted on the shell bottom 1 or both on the shell cover 3. 'Mounted on the fuse appliance base' in the present invention includes the followings: two identical elements are both mounted on the shell bottom of the base, two identical elements are both mounted on the shell cover of the base, and one of the two elements is mounted on the shell bottom of the base while the other is mounted on the shell cover of the base. Many similar conditions below that two identical elements are mounted or formed on the fuse appliance base all apply to this technical principle, and description is not given herein for the purpose of avoiding repetition.

Figure 6:
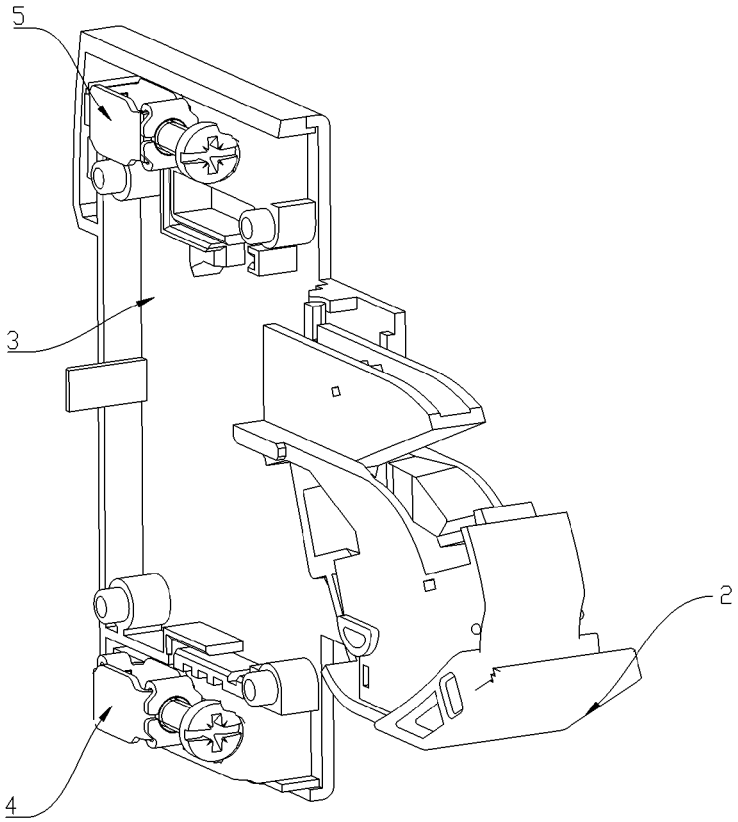
FIG. 6 is a perspective view of the fuse appliance as shown in FIG. 5, and illustrates an assembly relationship between the shell cover of the fuse appliance base and the fuse carrier of the fuse appliance under a pull-out state.

An operator achieves contact/breaking between the fuse 8 and the contacts 6, 9 of the fuse appliance by means of closing/opening operations on the fuse carrier 2. When the fuse appliance is under a closing state (the state as shown in FIG. 1 and FIG. 2), the closing operation results in contact of the moving contacts on the two ends of the fuse carrier 2 with the two static contacts 6, 9 on the fuse appliance base, at this moment, the fuse 8 is serially connected in the various breaking poles of the fuse appliance, hereinafter referred to as 'main circuit' for short. In the event of short circuit or overload in the main circuit, the fuse 8 will be overheated and accordingly molten so as to cut off the main circuit. When the fuse appliance is under an opening state (the state as shown in FIG. 3 and FIG. 4), the two contacts 6, 9 of the fuse appliance can be separated from the fuse 8, or the contact 6 is separated from the fuse 8, or the contact 9 is separated from the fuse 8. Preferred among the three schemes above is the first one as shown in FIG. 3, in which better safety is achieved especially when the fuse 8 is exposed under the opening state. The fuse 8 of the fuse appliance can be replaced when the fuse carrier 2 of the fuse appliance is under a pull-out state (the state as shown in FIG. 5 and FIG. 6).

Description is made below to the rotational-linear pulling type operation mechanism of the fuse appliance in the present invention with reference to FIG. 1 to FIG. 8. The rotational-linear pulling type operation mechanism comprises a semicircular rotary shaft structure 100 and a linear movement type guide rail structure 200. The semicircular rotary shaft structure 100 provides not only a rotational fulcrum for rotational operation movement, but also a linear guidance for linear pulling/linear pushing operation movement, that is to say, the semicircular rotary shaft structure 100 constrains the movement form of the fuse carrier 2 in relation to the fuse appliance base as rotational or linear movement. The linear movement type guide rail structure 200 provides a linear guidance for linear pulling/linear pushing operation movement, that is to say, the linear movement type guide rail structure 200 constrains the movement form of the fuse carrier 2 in relation to the fuse appliance base as linear movement. Both the semicircular rotary shaft structure 100 and the linear movement type guide rail structure 200 are involved in constraining the movement form of the fuse carrier 2 in relation to the fuse appliance base, so the key point of the rotational-linear pulling type operation mechanism in the present invention consists in solving the technical problems caused by co-constraining of the semicircular rotary shaft structure 100 and the linear movement type guide rail structure 200 on the linear movement of the fuse carrier 2, including how to realize cooperative working of the semicircular rotary shaft structure 100 and the linear movement type guide rail structure 200, or consists in overcoming the problem of mutual interference and conflict between the two mechanisms, i.e. the semicircular rotary shaft structure 100 and the linear movement type guide rail structure 200, in the process of co-constraining the movement form of the fuse carrier 2. The rotational-linear pulling type operation mechanism in the present invention is characterized in that, rotational operation movement is adopted when the fuse appliance is subjected to closing/opening operations, and linear pulling/linear pushing operation movement is adopted when the fuse appliance is subjected to pull-out/push-in operations. Due to the feature of small operation force, the rotational movement that is used for controlling the contact or breaking between the fuse 8 and the contacts 6, 9 of the fuse appliance can bring extremely easy and convenient closing/opening operations, and the linear pulling operation that is used for replacement of the fuse 8 can provide an isolation distance that is large enough. This isolation distance indicates a spacing between the fuse 8 and the contacts 6, 9 of the fuse appliance, and too small isolation distance could lead to the problem below: if there is a quite small breaking distance between the fuse 8 and the charged contacts 6, 9 of the fuse appliance, so the operation space for replacement of the fuse 8 is small, which causes inconvenient operation and further degraded insulating safety, as a result, hidden safety hazard in touching with charged parts during replacement of the fuse 8, but in the present invention, the problems of large operation force and small isolation distance in the prior art are effectually overcome by adopting the rotational-linear pulling type operation mechanism. Specifically, the aforementioned problems are skillfully settled by adopting the specific technical scheme below in the present invention. In the present invention, the semicircular rotary shaft structure 100 constrains two movement forms of the fuse carrier 2 in relation to the fuse appliance base, i.e. rotational movement and linear movement, besides, interchange between rotational movement and linear movement can also be accomplished, that is to say, the fuse carrier 2 can be changed to the state and position of linear movement from the state and position of rotational movement, and also, the fuse carrier 2 can be changed to the state and position of rotational movement from the state and position of linear movement. As described above, the rotational form of the fuse carrier 2 is used for the closing or opening operation of the fuse appliance, that is to say, the operation of contact or breaking between the fuse 8 and the two contacts 6, 9 of the fuse appliance is accomplished by rotation of the fuse carrier 2, which is formed by constraining of the semicircular rotary shaft structure 100, and this constraining enables the fuse carrier 2 to be rotated about the fulcrum provided by the semicircular rotary shaft structure 100. The linear movement form of the fuse carrier 2 is used for the pull-out or push-in operation of the fuse appliance, the pull-out or push-in operation indicates that the fuse carrier 2 is pulled out of or pushed into the hollow cavity formed by the shell bottom 1 and the shell cover 2 of the fuse appliance base, the pull-out operation is performed in order to check or replace the fuse 8 (the fuse 8 can be removed out of the cavity of the fuse carrier 2 only after the fuse carrier 2 is pulled out), and the push-in operation is to push the fuse carrier 2 into the hollow cavity of the fuse appliance base formed by the shell bottom 1 and the shell cover 3 and enter a rotatable position in order to perform rotational operation (i.e. closing operation) on the fuse carrier 2. According to another implementation of the present invention, the linear movement type guide rail structure 200 constrains only one movement form of the fuse carrier 2 in relation to the fuse appliance base, i.e. linear movement, and this linear movement is consistent, in movement direction, with the linear movement of the fuse carrier 2 constrained by the semicircular rotary shaft structure 100, which means no mutual interference. In the entire rotational operation process of the fuse carrier 2 (i.e. closing/opening operation of the fuse appliance), the linear movement type guide rail structure 200 must remove the constraining on the fuse carrier 2 constantly, namely, interference of the linear movement type guide rail structure 200 with rotation of the fuse carrier 2 is avoided all the time.

Figure 7:
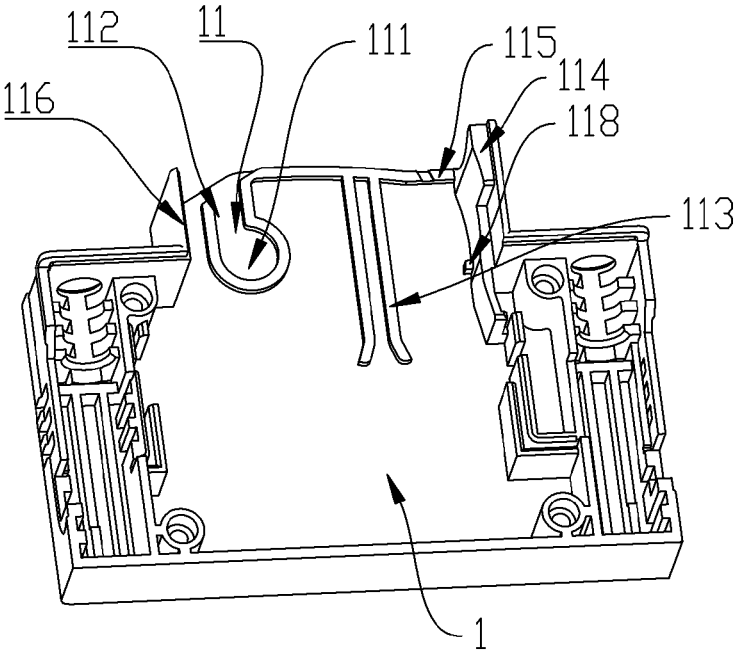
FIG. 7 is a structure view of the parts of the shell bottom of the fuse appliance base in accordance with the present invention.
Figure 8:
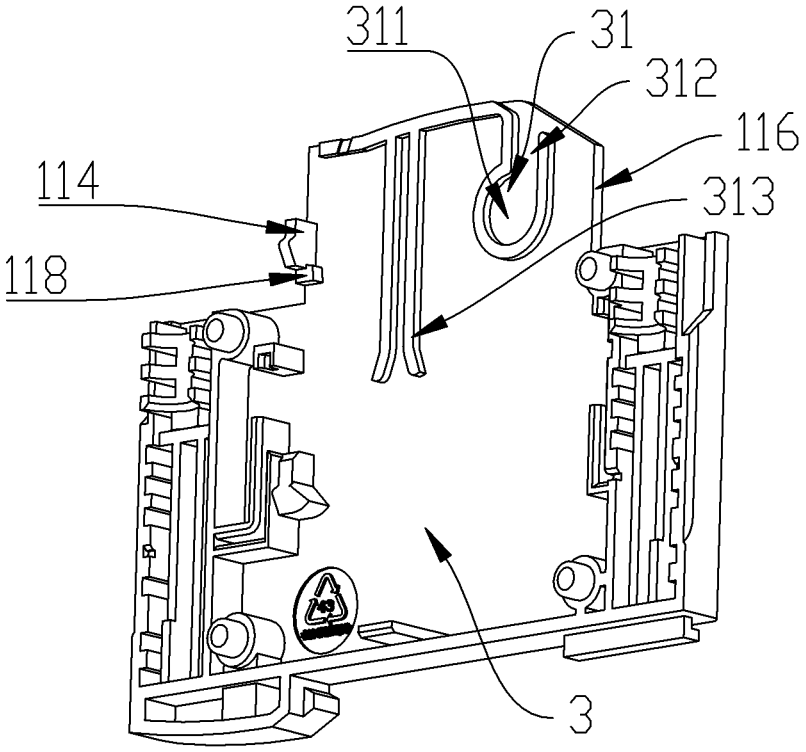
FIG. 8 is a structure view of the parts of the shell cover of the fuse appliance base in accordance with the present invention.

Referring to FIG. 7 and FIG. 8, the semicircular rotary shaft structure 100 comprises two semicircular convex shafts 21 formed on the fuse carrier 2 (see FIG. 1), a first circular straight groove 11 formed on the shell bottom 1 and a second circular straight groove 31 formed on the shell cover 3, the two semicircular convex shafts 21 are in mounting fit with the first circular straight groove 11 and the second circular straight groove 31 respectively, the first circular straight groove 11 is in mounting fit with one semicircular convex shaft 21 and the second circular straight groove 31 is in mounting fit with the other semicircular convex shaft 21, so the movement form of the fuse carrier 2 in relation to the shell bottom 1 and the shell cover 3 of the fuse appliance base can only be constrained as rotational or linear movement, and interchange between rotational movement and linear movement can be accomplished. That is to say, by means of mounting fit between the two semicircular convex shafts 21 and the first circular straight groove 11 and the second circular straight groove 31, the fuse carrier 2 can be constrained to perform rotational movement or linear movement respectively, and rotational movement and linear movement cannot be performed at the same time, but their interchange is accomplishable. The function of the semicircular rotary shaft structure 100 in constraining the fuse carrier 2 to have two movement forms, i.e. rotational movement and linear movement, and to accomplish an interchange between these two movement forms, is implemented by the specific structure below. As shown in FIG. 7, the first circular straight groove 11 comprises a first circular groove 111 and a first straight groove 112, the radius R1 of the first circular groove 111 is equal to the width H1 of the first straight groove 112, one inner side face of the first straight groove 112 is tangent to the inner circular face of the first circular groove 111, and the first straight groove 112 is communicated with the first circular groove 111. As shown in FIG. 8, the second circular straight groove 31 comprises a second circular groove 311 and a second straight groove 312, the radius R2 of the second circular groove 311 is equal to the width H2 of the second straight groove 312, one inner side face of the second straight groove 312 is tangent to the inner circular face of the second circular groove 311, and the second straight groove 312 is communicated with the second circular groove 311. As shown in FIG. 1 and FIG. 3, in the two semicircular convex shafts 21, the radius RA of the semicircular convex shaft 21 in mounting fit with the first circular straight groove 11 is equal to the radius R1 of the first circular groove 111, the radius RB of the semicircular convex shaft 21 in mounting fit with the second circular straight groove 31 is equal to the radius R2 of the second circular groove 311, the axes of the two semicircular convex shafts 21 are concentric, and the centers of the first circular groove 111 and the second circular groove 311 are concentric. Mounting fit of the two semicircular convex shafts 21 with the first circular straight groove 11 and the second circular straight groove 31 includes two stages of mounting fit, the first stage means mounting fit of the two semicircular convex shafts 21 with the first circular groove 111 and the second circular groove 311, and the second stage means mounting fit of the two semicircular convex shafts 21 with the first straight groove 112 and the second straight groove 312. As shown in FIG. 1 or FIG. 3, the first stage of mounting fit and the second stage of mounting fit can only be performed respectively, not simultaneously, but their interchange is accomplishable. Just because the first stage of mounting fit and the second stage of mounting fit as well as their interchange, rotational or linear movement form of the fuse carrier 2 in relation to the fuse appliance base is implemented by a set of mechanisms, and interchange between the two forms, i.e. rotational movement and linear movement, can be accomplished. Mounting fit of the two semicircular convex shafts 21 with the first circular groove 111 and the second circular groove 311 means that, the mounting fit between the semicircular convex shaft 21 with the radius RA and the first circular groove 111 with the radius R1 is clearance fit, and the mounting fit between the semicircular convex shaft 21 with the radius RB and the second circular groove 311 with the radius R2 is clearance fit. Referring to FIG. 1, when the two semicircular convex shafts 21 are located at a position in the first circular groove 111 and in the second circular groove 311 respectively (positions as shown in FIG. 1, namely, positions for the first stage of mounting fit), the first circular groove 111 and the second circular groove 311 constrain the semicircular convex shafts 21 to be rotated about a fulcrum, which is the common center of the first circular groove 111 and the second circular groove 311. It thus can be seen that, by means of mounting fit of the two semicircular convex shafts 21 with the first circular groove 111 of the first circular straight groove 11 and the second circular groove 311 of the second circular straight groove 31, the semicircular rotary shaft structure 100 constrains the movement form of the fuse carrier 2 (this fuse carrier 2 is fixedly connected or integrally formed with the two semicircular convex shafts 21) in relation to the shell bottom 1 (the first circular groove 111 is formed on this shell bottom 1) and the shell cover 3 (the second circular groove 311 is formed on the shell cover 3) of the fuse appliance base as rotational movement. Mounting fit of the two semicircular convex shafts 21 with the first straight groove 112 and the second straight groove 312 means that, the mounting fit between the semicircular convex shaft 21 with the radius RA and the first straight groove 112 with the width H1 is slide fit, and the mounting fit between the semicircular convex shaft 21 with the radius RB and the second straight groove 312 with the width H2 is slide fit as well. The first circular straight groove 11 and the second circular straight groove 31 are arranged symmetrically, and this symmetrical arrangement means that: the first circular groove 111 and the second circular groove 311 are concentric, in addition, the first straight groove 112 and the second straight groove 312 are parallel with each other. The first straight groove 112 and the second straight groove 312 are linear grooves, so when the two semicircular convex shafts 21 are respectively located at the positions of the first straight groove 112 and the second straight groove 312 (these positions are not shown in the drawings, i.e. positions for the second stage of mounting fit), the two semicircular convex shafts 21 can slide linearly inside the first straight groove 112 and the second straight groove 312. It thus can be seen that, by means of mounting fit of the two semicircular convex shafts 21 with the first straight groove 112 of the first circular straight groove 11 and the second straight groove 312 of the second circular straight groove 31, the semicircular rotary shaft structure 100 constrains the movement form of the fuse carrier 2 (this fuse carrier is fixedly connected or integrally formed with the two semicircular convex shafts 21) in relation to the shell bottom 1 (the first straight groove 112 is formed on this shell bottom 1) and the shell cover 3 (the second straight groove 312 is formed on the shell cover 3) of the fuse appliance base as linear movement. The first circular groove 111 of the first circular straight groove 11 is communicated with the first straight groove 112 and one inner side face of the first straight groove 112 is tangent to the inner circular face of the first circular groove 111, as well as the second circular groove 311 of the second circular straight groove 31 is communicated with the second straight groove 312 and one inner side face of the second straight groove 312 is tangent to the inner circular face of the second circular groove 112, so there must be a transition position for the two semicircular convex shafts 21, as shown in FIG. 3, which is not only in the first circular groove 111 and the second circular groove 311, but also in the first straight groove 112 and the second straight groove 312, and only at this transition position can the two semicircular convex shafts 21 perform both rotation and movement, that is to say, the semicircular rotary shaft structure 100 constrains the movement form of the fuse carrier 2 in relation to the fuse appliance base to accomplish an interchange between rotational movement and linear movement.

The two semicircular convex shafts 21 have the same structure and both are semi-cylinders having a semicircular cross section, so each semicircular convex shaft 21 comprises a plane 212 and a circular arc face 213, the plane 212 is a plane that passes over the axis of the semicircular convex shaft 21 and parallel with the axis, and the circular arc face 213 is a semi-cylindrical face of the semi-cylinder of the semicircular convex shaft 21. The two semicircular convex shafts 21 as well as the first circular groove 111 and the second circular groove 311 are arranged in such a relationship that: when the fuse appliance is under a closing state, the two semicircular convex shafts 21 are located at the positions inside the first circular groove 111 and the second circular groove 311 respectively (positions as shown in FIG. 1), at this moment, the circular arc faces 213 of the two semicircular convex shafts 21 face upwards respectively (the up-and-down relationship is based upon FIG. 1) and face towards the first straight groove 112 and the second straight groove 312 respectively, while the two planes 212 of the two semicircular convex shafts 21 face downwards respectively (the up-and-down relationship is based upon FIG. 1) and are not parallel with the two inner side faces of the first straight groove 112, namely, the two planes 212 face towards the inner circular faces of the first circular groove 111 and the second circular groove 311 respectively. RA=H1 and RB=H2, so the diameter 2RA>H1 and the diameter 2RB>H2, the diameters of the two semicircular convex shafts 21 are larger than the widths of the first straight groove 112 and the second straight groove 312 respectively, hence, the two semicircular convex shafts 21 are stably constrained within the first straight groove 112 and the second straight groove 312 under the closing state respectively, in order to stably keep the fuse appliance under the closing state. When the fuse appliance is under an opening state, the two semicircular convex shafts 21 are located at the transition position respectively (position as shown in FIG. 3), at this moment, the two planes of the two semicircular convex shafts 21 are parallel with the two inner side faces of the first straight groove 112 and the second straight groove 312 respectively, besides, the radii of the two semicircular convex shafts 21 are equal to the widths of the first straight groove 112 and the second straight groove 312 respectively, i.e. RA=H1 and RB=H2, so under this state, by applying an outwards-pulling operation force to the fuse carrier 2, the two semicircular convex shafts 21 can perform outward linear movement inside the first straight groove 112 and the second straight groove 312, and this movement is not stopped until the fuse carrier 2 is pulled out. At the transition position, the two semicircular convex shafts 21 can be rotated inside the first circular groove 111 and the second circular groove 311 in a clockwise direction as shown in FIG. 3 if a clockwise torque as shown in FIG. 3 is applied to the fuse carrier 2, and this rotation is not stopped until the fuse carrier 2 is returned to the closing state.

In the embodiment as shown in FIG. 3, the first straight groove 112 is arranged on the left side of the first circular groove 111, namely, the first straight groove 112 is aligned with the left half circle of the first circular groove 111, and it is not difficult to realize that the first straight groove 112 is aligned with the right half circle of the first circular groove 111 in another alternative scheme of this embodiment. In this scheme, the two semicircular convex shafts 21 as well as the first straight groove 112 and the second straight groove 312 need to be arranged in such a relationship that: when the fuse appliance is under a closing state, the two planes 212 of the two semicircular convex shafts 21 face upwards respectively (the up-and-down relationship is based upon FIG. 1) and face towards the first straight groove 112 and the second straight groove 312 respectively, the two circular arc faces 213 of the two semicircular convex shafts 21 face downwards respectively (the up-and-down relationship is based upon FIG. 1, i.e. the two circular arc faces face towards the inner circular faces of the first circular groove 111 and the second circular groove 311), and the two planes 212 are not parallel with the two inner side faces of the first straight groove 112 and the second straight groove 312 respectively. When the fuse appliance is under an opening state, the two planes 212 of the two semicircular convex shafts 21 are parallel with the two inner side faces of the first straight groove 112 and the second straight groove 312 respectively.

In the embodiments as shown in FIG. 1 and FIG. 3, the two semicircular convex shafts 21 are arranged on the fuse carrier 2 and the first circular straight groove 11 and the second circular straight groove 31 are arranged on the shell bottom 1 and the shell cover 3 of the base respectively, and another alternative scheme is as follows: the semicircular rotary shaft structure 100 comprises a first circular straight groove and a second circular straight groove formed on the fuse carrier 2 respectively and two semicircular convex shafts formed on the shell bottom 1 and the shell cover 3 of the base respectively, and the two semicircular convex shafts are in mounting fit with the first circular straight groove and the second circular straight groove respectively. This scheme is the same as the embodiment as shown in the drawings except for arrangement relationship, therefore, its working principle as well as structures and parameters like widths (H1, H2) of the straight grooves, radii (R1, R2) of the circular grooves and shape of the semicircular convex shafts are the same as those in the embodiment as shown in the drawings.

The rotational-linear pulling type operation mechanism of the present invention described above is composed of the semicircular rotary shaft structure 100, and can also be composed of the semicircular rotary shaft structure 100 and the linear movement type guide rail structure 200 together. The linear movement type guide rail structure 200 comprises two slider protrusions 24 formed on the fuse carrier 2, a first guide rail groove 113 formed on the shell bottom 1 and a second guide rail groove 313 formed on the shell cover 3; when the fuse appliance is under a closing state, these two slider protrusions 24 are separated from the first guide rail groove 311 and the second guide rail groove 313 respectively (as shown in FIG. 1); when the fuse appliance is under an opening state, these two slider protrusions 24 enter the inlets of the first guide rail groove 311 and the second guide rail groove 313 respectively (as shown in FIG. 3), and are in mounting fit with the first guide rail groove 113 and the second guide rail groove 313 respectively in the push-in/pull-out operation process of the fuse appliance (as shown in FIG. 5), and this mounting fit allows for linear movement of the fuse carrier 2 in relation to the fuse appliance base. The first guide rail groove 113 and the second guide rail groove 313 are symmetrically arranged in parallel and are parallel with the first straight groove 112 and the second straight groove 312, as a result, such an arrangement reaches a purpose that: linear movement of the fuse carrier 2 constrained by the semicircular rotary shaft structure 100 is consistent, in movement direction, with linear movement of the fuse carrier 2 constrained by the linear movement type guide rail structure 200, in order to guarantee no mutual interference between the two linear movements of the fuse carrier 2 constrained by the semicircular rotary shaft structure 100 and the linear movement type guide rail structure 200 respectively. The two slider protrusions 24 are in slide fit with the first guide rail groove 113 and the second guide rail groove 313 respectively. As described above, the rotational movement form of the fuse carrier 2 that is constrained by the semicircular rotary shaft structure 100 is used for the closing or opening operation of the fuse appliance, and the linear movement form of the fuse carrier 2 that is constrained by the semicircular rotary shaft structure 100 and the linear movement type guide rail structure 200 together is used for the pull-out or push-in operation of the fuse appliance. Adopted in the embodiments as shown in FIG. 1, FIG. 3 and FIG. 5 is a structure in which linear movement form can be provided by these two parts, one is the semicircular rotary shaft structure 100 and the other is the linear movement type guide rail structure 200, and the advantage is that the pull-out or push-in stroke of the fuse carrier 2 can be increased on the premise of not raising the volume of the fuse appliance base, in order to obtain a perfect large isolation distance. In other words: if reduction of the volumes of the shell bottom 1 and the shell cover 3 is not considered, i.e. on the basis as shown in FIG. 5, the shell of the shell bottom 1 and the shell cover 3 is extended upwards so that the semicircular convex shafts 21 are not separated from the first straight groove 112 and the second straight groove 312, use of the linear movement type guide rail structure 200 is avoidable. If increase of the pull-out or push-in stroke of the fuse carrier 2 is not considered, i.e. on the basis as shown in FIG. 5, pulling the fuse carrier 2 out of the first straight groove 112 and the second straight groove 312 is limited, use of the linear movement type guide rail structure 200 is avoidable as well. It thus can be seen that, the fundamental purpose of using the linear movement type guide rail structure 200 is to acquire a perfect large isolation distance and to reduce the volume of the fuse appliance. Inlets at the lower ends of the first guide rail groove 113 and at the second guide rail groove 313 are both horn-shaped, and the two slider protrusions 24 enter the horn-shaped inlet of the first guide rail groove 113 and the horn-shaped inlet of the second guide rail groove 313 respectively when the fuse appliance is under an opening state (i.e. pull-out preparation state, as shown in FIG. 3). Through the horn-shaped inlets, the two slider protrusions 24 are guided to smoothly enter the first guide rail groove 113 and the second guide rail groove 313 respectively. The upper end of the first guide rail groove 113 is blocked off by the shell bottom 1 and the second guide rail groove 313 is blocked off by the shell cover 3, and by means of this block-off, pulling the two slider protrusions 24 out of the first guide rail groove 113 and the second guide rail groove 313 is prevented, that is to say, when the fuse carrier 2 is pulled out to reach the maximal position as shown in FIG. 5, the two slider protrusions 24 are still retained inside the first guide rail groove 113 and the second guide rail groove 313. In the embodiment as shown in FIG. 3, the two slider protrusions 24 of the linear movement type guide rail structure 200 are formed on the base respectively, one of the slider protrusions can be formed on the shell bottom 1 while the other is formed on the shell cover 3, and the first guide rail groove and the second guide rail groove are formed on the fuse carrier 2 respectively.

In order to improve convenience and safety in operation, the fuse appliance of the present invention further comprises an anti-over-rotation positioning structure and an anti-turn back rotation positioning structure to prevent free rotation of the fuse carrier 2 under the closing state. The anti-over-rotation positioning structure is used for limiting continuous forward over-rotation of the fuse carrier 2 in the closing operation direction under the closing state (rotation in a clockwise direction as shown in FIG. 1). The anti-turn back rotation positioning structure is used for limiting turn back rotation of the fuse carrier 2 under the closing state (rotation in an anti-clockwise direction as shown in FIG. 1). As shown in FIG. 1, the anti-over-rotation positioning structure comprises protrusions 118 formed on the fuse appliance base and a convex shoulder 211 formed on the fuse carrier 2, the protrusions 118 come into contact with the convex shoulder 211 when the fuse carrier 2 is rotated to a closing position, and forward over-rotation of the fuse carrier 2 is limited because the convex shoulder 211 is stopped by the protrusions 118. The number of the protrusions 118 described herein are two, with one being formed on the shell bottom 1 and the other being formed on the shell cover 3, i.e. 'protrusions 118 formed on the fuse appliance base' described above, and it is not difficult to realize that an alternative scheme is as follows: both the two protrusions 118 can be formed on the shell bottom 1 or the shell cover 3. As shown in FIG. 3, the anti-turn back rotation positioning structure comprises a flange 115 formed on the fuse appliance base and lug bosses formed on the two sides of the fuse carrier 2, the lug bosses 27 are stopped and clamped by the flange 115 to limit free turn back rotation of the fuse carrier 2 when the fuse carrier 2 is rotated to the closing position. During the closing operation, the positional relationship between the lug bosses 27 and the flange 115 is changeable, i.e. from the position as shown in FIG. 3 to the position as shown in FIG. 1, the lug bosses 27 need to pass over the flange 115 in this change process, such a pass-over action is implemented through elastic deformation and matching between the lug bosses 27 and the flange 115, and the force required by this elastic deformation is provided by a closing operation force, therefore, the lug bosses 27 are actually clamped by the flange 115 at the closing position, and undoubtedly stopped by the flange 115 as well, thereby limiting turn back rotation of the fuse carrier 2. The circular lug bosses 27 are disposed below the flange 115 on the base only when the fuse carrier 2 and the contacts 6, 9 of the fuse appliance are under the closing state, the primary reason for this is that, the fuse 8 is fixedly clamped by the contacts after mounted, and the fuse, though fixed at this moment, can still be rotated within a particular range since the cavity for the fuse carrier 2 is expanded outwards during the closing operation. Therefore, the lug bosses 27 are limited by the flange 115 to prevent the fuse from being rotated out of the cavity easily. The shell bottom and the shell cover of the fuse appliance base are both made of plastic parts with a particular elasticity, so limitation to normal operation can be overcome only by a slight force application during operation. During the opening operation, the positional relationship between the lug bosses 27 and the flange 115 is a change from the position as shown in FIG. 1 to the position as shown in FIG. 3, and it is quite apparent that the lug bosses 27 still need to pass over the flange 115, this pass-over is implemented through elastic deformation and matching between the lug bosses 27 and the flange 115, and the force required by this elastic deformation is provided by an opening operation force. In addition to the scheme shown in the embodiment of FIG. 3, the flange 115 can also be formed on the shell bottom 1 only or on the shell cover 3 only.

Referring to FIG. 1, FIG. 3 and FIG. 5, the fuse appliance further comprises a pull-out/push-in guide structure and an anti-pull-off structure. The pull-out/push-in guide structure is used for guiding the pull-out or push-in direction of the fuse carrier 2; the small and thin semicircular rotary shaft structure 100, though having the function of guiding the pull-out or push-in direction of the fuse carrier 2 as well, is sometimes not strong enough to reliably bear an operation force required by pull-out or push-in because of the volume and weight of the fuse carrier 2, thus preferably, a pull-out/push-in guide structure capable of bearing a large pull-out or push-in operation force is added. The pull-out/push-in guide structure comprises a guide plane 116 formed on base and a guide plane 28 formed on the fuse carrier 2. The guide plane 116 is parallel with and comes into contact with the guide plane 28 when the fuse carrier 2 is rotated to a pull-out preparation position (position as shown in FIG. 3, i.e. the opening position). Relative sliding is generated between the guide plane 116 and the guide plane 28 in the pull-out/push-in process of the fuse carrier 2. The guide plane 116 is arranged in parallel with the first straight groove 112 and the second straight groove 312, that is to say, the guide plane 116 is parallel with the first circular straight groove 11 and the second circular straight groove 31. Arrangement of the guide plane 116 is as follows: the two guide planes 116 can be formed on the shell bottom 1 and the shell cover 3 respectively, as shown in the drawings, furthermore, the guide plane 116 can also be formed on the shell bottom 1 only or on the shell cover 3 only. The anti-pull-off structure is used for preventing the fuse carrier 2 from being separated from the shell bottom 1 or the shell cover during the pull-out operation. The anti-pull-off structure comprises an anti-pull-off stop block 114 formed on the fuse appliance base and an anti-pull-off lug boss 26 formed on the fuse carrier 2, the anti-pull-off lug boss 26 on the fuse carrier 2 is similar to the lug boss 27 in function, the anti-pull-off lug boss 26 slides into a shell lug boss 317 after the fuse carrier 2 is rotated to a breaking position, so as to avoid easy turn back rotation of the fuse carrier 2, which achieves two effects: 1, a turning point that shows the feasibility of pull-out operation in the next action is provided, and 2, when the fuse 8 is replaced in case that the fuse carrier 2 is not pulled out after rotated out, reduction of the isolation distance between one end of the fuse carrier 2 and the contacts of the fuse appliance, which is caused by turn back rotation of the fuse carrier 2, is avoided, so as to ensure safe operation. After the fuse carrier 2 is pulled out, the anti-pull-off lug boss 26 slides into a shell lug boss 314 to avoid easy push-in of the fuse carrier 2, which achieves the effect that: inconvenience in mounting the fuse caused by movement of the fuse carrier 2 is avoided when the fuse 8 is replaced or mounted, and the fuse carrier 2, after being limited, can be fixed at this set position to a certain extent. When the fuse carrier 2 is pulled out to reach the maximal pull-out position (position as shown in FIG. 5), the anti-pull-off lug boss 26 is stopped by the anti-pull-off stop block 114 in order to prevent the fuse carrier 2 from pull-out. The fuse carrier 2 is a plastic part, so the anti-pull-off lug boss 26 has a particular elasticity and limitation can be removed by particular operation only.

The upper end of the first guide rail groove 113 of the linear movement type guide rail structure 200 is blocked off by the shell bottom 1 and the upper end of the second guide rail groove 313 is blocked off by the shell cover 3, so the linear movement type guide rail structure 200 also has an anti-pull-off structure itself, as a result, the anti-pull-off structure consisting of the anti-pull-off stop block 114 and the anti-pull-off lug boss 26 basically plays a role of assisting in anti-pull-off, in order to help the anti-pull-off function of the linear movement type guide rail structure 200 withstand a large torque under a large pull-out force in the pull-out process. Therefore, in the presence of the linear movement type guide rail structure 200, the anti-pull-off structure can be removed if there is a small pull-out operation force, however, in the absence of the linear movement type guide rail structure 200, the anti-pull-off structure is indispensable to prevent inconvenient push-in operation and reliability degradation generated by pull-off of the fuse carrier 2.

Figure 9:
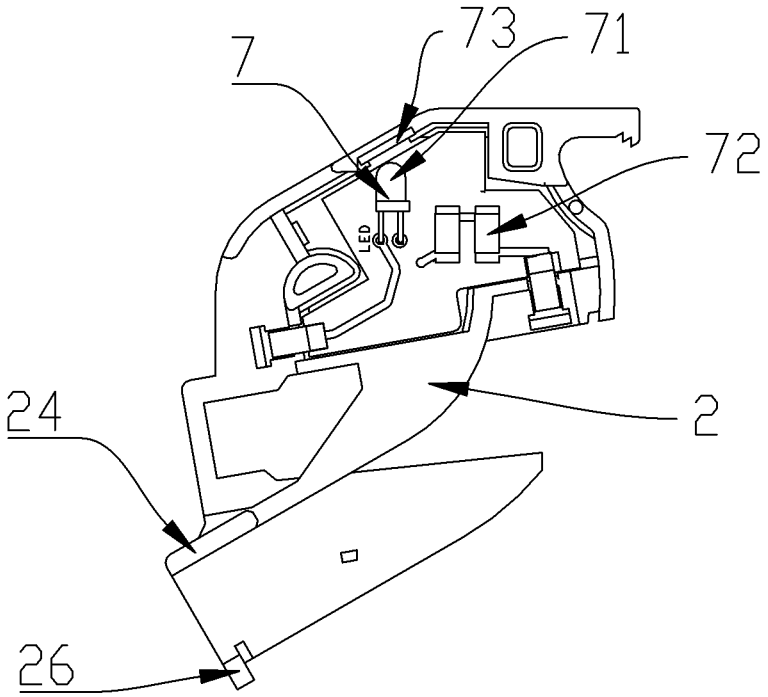
FIG. 9 is a structure view of the parts of the fuse carrier of the fuse appliance in accordance with the present invention, and illustrates the structure of the blown fuse indicator.

Referring to FIG. 1, FIG. 3, FIG. 5 and FIG. 9, the fuse appliance of the present invention further comprises a blown fuse indicator 7, which can be used for indicating whether the fuse 8 is mounted when the fuse appliance is under a closing state and also indicating whether the fuse 8 is blown. As shown in FIG. 9, the blown fuse indicator 7 comprises a resistor 72 mounted on the fuse carrier 2, an LED lamp 71, a contact piece and a display window 73 arranged on the fuse carrier 2. The contact piece is connected with the resistor 72 and the LED lamp 71 in series and is connected with the fuse 8 in parallel. During normal working, the fuse is well short-circuited in the pole circuit, and the LED lamp 72 does not work at this time; when the fuse 8 is blown, the circuit of the blown fuse indicator 7 is switched on due to electrical connection between the contact piece connected with the fuse 8 and the contacts 6, 9 of the fuse appliance, the LED lamp 71 is on and the light of the LED lamp 71 can be displayed through the display window 73, which indicates that the fuse appliance has functioned. When the fuse 8 is not mounted and if the fuse appliance is under a closing state, the LED lamp in the circuit of the indicator 7 can also be turned on due to electrical connection between the contact piece and the contacts of the fuse appliance, thereby reminding an operator of not mounting the fuse 8 in the fuse appliance.

The invention claimed is:

1. A fuse appliance, comprising a fuse carrier made of insulating material and a fuse appliance base made of insulating material, the fuse carrier having a fuse cavity for receiving a fuse, moving contacts being arranged on the fuse carrier on two sides of the fuse cavity, the fuse carrier being arranged, in a manually operable way, in a hollow cavity of the fuse appliance base that is formed by assembling a shell bottom and a shell cover, so as to remove or insert the fuse when the fuse is replaced by an operator, and fixed contacts and wiring terminals arranged on the sides of the fuse appliance base respectively, said fixed contacts come into contact with the moving contacts arranged on the fuse carrier, said wiring terminals electrically connect the fixed contacts of the fuse appliance with a main circuit respectively, wherein, the fuse appliance further comprises a rotational-linear pulling type operation mechanism formed by a semicircular rotary shaft structure, the semicircular rotary shaft structure comprises two semicircular convex shafts and first and second circular straight grooves, and the two semicircular convex shafts are in mounting fit with the first circular straight groove and the second circular straight groove respectively, so that the fuse carrier performs rotational movement or linear movement in relation to the fuse appliance base, further wherein during a closing operation stage of the fuse appliance, the fuse carrier performs rotational movement in relation to the fuse appliance base only and cannot perform linear movement; during an opening operation stage of the fuse appliance, the fuse carrier performs an interchange between rotational movement and linear movement, in relation to the fuse appliance base at a transition position where the fuse carrier is pulled out of or pushed into the fuse appliance; and during a pull-out or push-in operation stage of the fuse appliance, the fuse carrier performs linear movement only in relation to the fuse appliance base.

2. A fuse appliance, comprising a fuse carrier made of insulating material and a fuse appliance base made of insulating material, the fuse carrier having a fuse cavity for receiving a fuse, moving contacts being arranged on the fuse carrier on two sides of the fuse cavity, the fuse carrier being arranged, in a manually operable way, in a hollow cavity of the fuse appliance base that is formed by assembling a shell bottom and a shell cover, so as to remove or insert the fuse when the fuse is replaced by an operator, and fixed contacts and wiring terminals arranged on two sides of the fuse appliance base respectively, said fixed contacts come into contact with the moving contacts arranged on the fuse carrier, said wiring terminals electrically connect the fixed contacts of the fuse appliance with a main circuit respectively, wherein, the fuse appliance further comprises a rotational-linear pulling type operation mechanism; the rotational-linear pulling type operation mechanism comprises a semicircular rotary shaft structure and a linear movement type guide rail structure;

the semicircular rotary shaft structure comprises two semicircular convex shafts, a first circular straight groove and a second circular straight groove, the linear movement type guide rail structure comprises two slider protrusions, a first guide rail groove and a second guide rail groove, the first guide rail groove and the second guide rail groove arranged in parallel; and the two slider protrusions are in slide fit with the first guide rail groove and the second guide rail groove respectively;

the two semicircular convex shafts of the semicircular rotary shaft structure are in mounting fit with the first circular straight groove and the second circular straight groove respectively, and the two slider protrusions of the linear movement type guide rail structure are in mounting fit with the first guide rail groove and the second guide rail groove respectively, so that the fuse carrier performs rotational movement or linear movement in relation to the fuse appliance base, further wherein during a closing operation stage of the fuse appliance, the two slider protrusions are separated from the first guide rail groove and the second guide rail groove respectively, whereby the fuse carrier performs rotational movement only in relation to the fuse appliance base and cannot perform linear movement; during an opening operation stage of the fuse appliance, the two slider protrusions enter inlets of the first guide rail groove and the second guide rail groove respectively, whereby the fuse carrier performs an interchange between rotational movement and linear movement, in relation to the fuse appliance base at a transition position where the fuse carrier is pulled out of or pushed into the fuse appliance; during a pull-out or push-in operation stage of the fuse appliance, the fuse carrier is constrained to perform linear movement only in relation to the fuse appliance base; the linear movement of the fuse carrier being constrained by the semicircular rotary shaft structure and by the linear movement type guide rail structure.

3. The fuse appliance according to claim 1, wherein, the two semicircular convex shafts are formed on the fuse carrier, the first circular straight groove and the second circular straight groove are formed on the fuse appliance base; or one of the two semicircular convex shafts is formed on the shell bottom of the fuse appliance base while the other is formed on the shell bottom of the fuse appliance base, and the first circular straight groove and the second circular straight groove are formed on the fuse carrier respectively;

the first circular straight groove comprises a first circular groove and a first straight groove, a radius R1 of the first circular groove is equal to a width H1 of the first straight groove, one inner side face of the first straight groove is tangent to an inner circular face of the first circular groove, and the first straight groove communicates with the first circular groove;

the second circular straight groove comprises a second circular groove and a second straight groove, a radius R2 of the second circular groove is equal to a width H2 of the second straight groove, one inner side face of the second straight groove is tangent to an inner circular face of the second circular groove, and the second straight groove communicates with the second circular groove;

a radius RA of the semicircular convex shaft in mounting fit with the first circular straight groove is equal to the radius R1 of the first circular groove, a radius RB of the semicircular convex shaft in mounting fit with the second circular straight groove is equal to the radius R2 of the second circular groove, axes of the two semicircular convex shafts are concentric, and centers of the first circular groove and the second circular groove are concentric;

the first circular straight groove and the second circular straight groove are arranged symmetrically, the two semicircular convex shafts are in clearance fit with the first circular groove and the second circular groove respectively, and the two semicircular convex shafts are in slide fit with the first straight groove and the second straight groove respectively.

4. The fuse appliance according to claim 1, wherein, the two semicircular convex shafts are identical semi-cylinders both having a semicircular cross section;

each semicircular convex shaft comprises a plane and a circular arc face both parallel with the axis of the semicircular convex shaft and the circular arc face is a semi-cylindrical face of the semi-cylinder of the semicircular convex shaft.

5. The fuse appliance according to claim 2, wherein, the two slider protrusions of the linear movement type guide rail structure are formed on the fuse carrier, the first guide rail groove is formed on the shell bottom of the fuse appliance base, the second guide rail groove is formed on the shell cover of the fuse appliance base; or one of the two slider protrusions of the linear movement type guide rail structure is formed on the shell bottom of the fuse appliance base while the other is formed on the shell bottom of the fuse appliance base, and the first guide rail groove and the second guide rail groove are formed on the fuse carrier respectively;

the inlets of the first guide rail groove and the second guide rail groove are horn-shaped and located at lower ends of the first guide rail groove and second guide rail groove, so as to guide the two slider protrusions to enter the first guide rail groove and the second guide rail groove respectively;

upper ends of the first guide rail groove and the second guide rail groove are both blocked off by the shell bottom of the fuse appliance base, so as to prevent the two slider protrusions from being pulled out of the first guide rail groove and the second guide rail groove respectively.

6. The fuse appliance according to claim 1, wherein, the fuse appliance further comprises an anti-over-rotation positioning structure for the fuse carrier, the anti-over-rotation positioning structure comprises protrusions formed on the shell bottom and/or shell cover and a convex shoulder formed on the fuse carrier, and when the fuse carrier is rotated to a closing position, the protrusions come into contact with the convex shoulder to limit forward over-rotation of the fuse carrier under a closing state.

7. The fuse appliance according to claim 1, wherein, the fuse appliance further comprises an anti-turn back-rotation positioning structure for the fuse carrier, the anti-turn back-rotation positioning structure comprises a flange formed on at least one of the shell bottom and shell cover and lug bosses formed on the fuse carrier, and when the fuse carrier is rotated to a closing position, the lug bosses are clamped by the flange to limit free turn back rotation of the fuse carrier under a closing state.

8. The fuse appliance according to claim 1, wherein, the fuse appliance further comprises a first guide plane formed on at least one of the shell bottom and shell cover and a second guide plane formed on the fuse carrier;

the first guide plane is parallel with the first circular straight groove and the second circular straight groove;

when the fuse carrier is rotated to an opening position, the first guide plane is parallel with and comes into contact with the second guide plane;

and in the pull-out or push-in operation stage of the fuse carrier, contact and relative sliding are generated between the first guide plane and the second guide plane.

9. The fuse appliance according to claim 1, wherein, the fuse appliance further comprises an anti-pull-off stop block formed on at least one of the shell bottom and shell cover and an anti-pull-off lug boss formed on the fuse carrier;

when the fuse carrier is pulled out to reach a maximal pull-out position, the anti-pull-off lug boss is stopped by the anti-pull-off stop block in order to prevent the fuse carrier from being pulled out.

10. The fuse appliance according to claim 1, wherein, the cavity of the fuse carrier is in the shape of a conical platform with an expanded opening, so that the fuse can be inserted into or removed out of the cavity conveniently;

a fuse stop block is arranged at the opening of the cavity of the fuse carrier so as to avoid free falling of the fuse inside the cavity.

11. The fuse appliance according to claim 1, wherein, the fuse appliance further comprises a blown fuse indicator arranged on the fuse carrier, the blown fuse indicator comprises a resistor mounted on the fuse carrier, an LED lamp, a contact piece and a display window, the contact piece is connected with the resistor and the LED lamp in series and is connected with the fuse in parallel, and when the fuse appliance is under a closing state, but no fuse is mounted or the fuse is blown, the LED lamp is on.

* * * * *